US005328570A

United States Patent [19]

Wolf et al.

[11] Patent Number: 5,328,570

[45] Date of Patent: Jul. 12, 1994

[54] HYDRAULIC SUPPORT DEVICE IN A PAPER MAKING MACHINE

[75] Inventors: Robert Wolf, Herbrechtingen; Christian Schiel, Heidenheim, both of Fed. Rep. of Germany

[73] Assignee: J. M. Voith, Fed. Rep. of Germany

[21] Appl. No.: 861,847

[22] PCT Filed: Mar. 22, 1991

[86] PCT No.: PCT/EP91/00558

§ 371 Date: Jun. 17, 1992

§ 102(e) Date: Jun. 17, 1992

[87] PCT Pub. No.: WO91/14825

PCT Pub. Date: Oct. 3, 1991

[30] Foreign Application Priority Data

Mar. 26, 1990 [DE] Fed. Rep. of Germany ..... 4009628

[51] Int. Cl.[5] ..... D21F 1/02; D21F 1/54

[52] U.S. Cl. ..... 162/336; 162/301; 162/352

[58] Field of Search ..... 162/336, 301, 352, 347, 162/300; 100/269 A; 92/92

[56] References Cited

U.S. PATENT DOCUMENTS

| | | | |
|---|---|---|---|
| 2,373,770 | 4/1945 | Martin | 100/269 A |
| 3,017,930 | 1/1962 | Dunlap | 162/352 |
| 3,187,850 | 6/1965 | Russell | 92/92 |
| 3,788,651 | 1/1974 | Brown et al. | 277/34 |
| 3,994,773 | 11/1976 | Wolf et al. | 162/148 |
| 4,371,175 | 2/1983 | Van Dyk, Jr. | 277/34 |
| 4,559,105 | 12/1985 | Sennett et al. | 162/352 |
| 4,770,745 | 9/1988 | Hildebrand et al. | 162/336 |
| 4,865,692 | 9/1989 | Kade et al. | 162/352 |
| 5,034,101 | 7/1991 | Wolf et al. | 162/336 |
| 5,078,835 | 1/1992 | Schiel et al. | 162/352 |

FOREIGN PATENT DOCUMENTS

| | | | |
|---|---|---|---|
| 2069896 | 3/1987 | Japan | 162/300 |
| 8902499 | 3/1989 | PCT Int'l Appl. . | |

OTHER PUBLICATIONS

Baumann, "New Top-Wire Forming Unit Provides Flexibility, Retrofit on Fourdrinier" Pulp & Poper, Apr., 1989.

*Primary Examiner*—Karen M. Hastings

*Attorney, Agent, or Firm*—Ostrolenk, Faber, Gerb & Soffen

[57] ABSTRACT

A hydraulic support device in a paper making machine for supporting a first beam (52) on a second beam (53), having a pressure cushion (54) between the two beams. The pressure prevailing in the pressure cushion is variable but it is uniform over the entire length of the pressure cushion. The pressure cushion (54) rests on a contact surface of the first beam (52). The width (b) of the contact surface as seen in cross section is less than the total width (B) of the pressure cushion (54). A free space (55) into which a loop of the pressure cushion (54) can penetrate is provided on each side of the contact surface.

17 Claims, 3 Drawing Sheets

I
31
43
13
A
42
19
19'
32
33
30
16
17
11
11
A
KB
49
23
22
26'
I

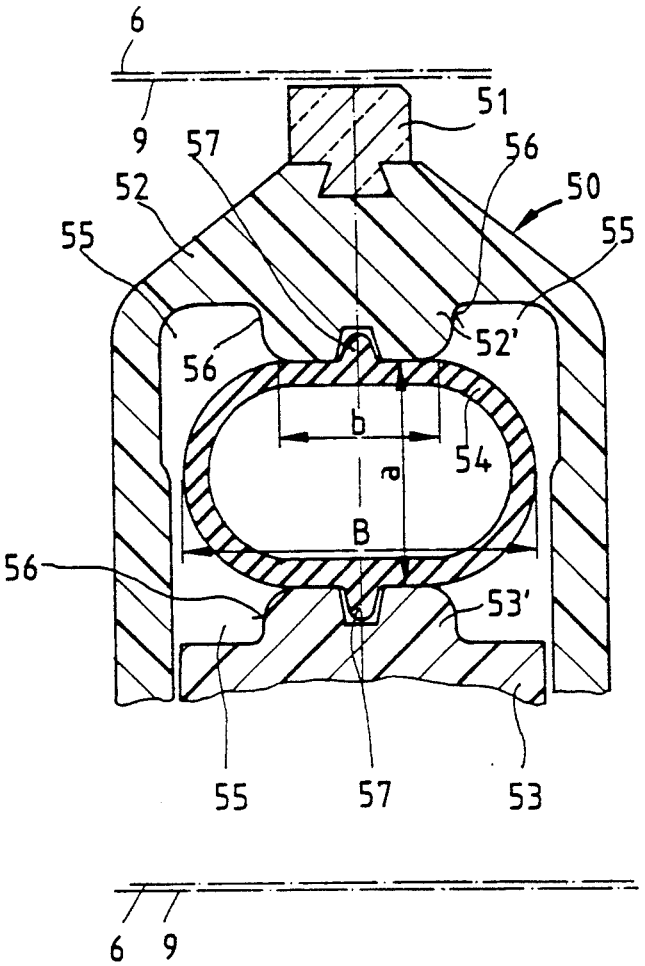
Fig. 2
Fig. 2A
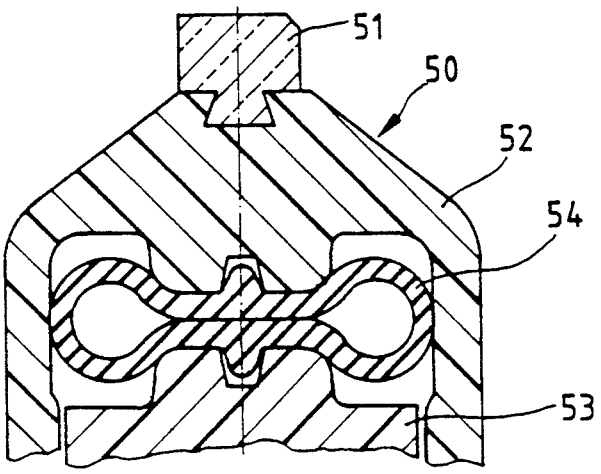

HYDRAULIC SUPPORT DEVICE IN A PAPER MAKING MACHINE

BACKGROUND OF THE INVENTION

1. Field of the Invention

The present invention relates to a hydraulic support device for supporting a first beam on a second beam which extends parallel thereto.

2. Description of the Related Art

There are two fundamentally different fields of use for such a hydraulic support device:

1. One of the two beams is part of a flow guide wall, for instance of a head box of a paper making machine. Here the purpose of the hydraulic support device is to maintain the flow guide wall free of flexure. The pressure of the fluid (namely, the fiber suspension) is transmitted here from the flow guide wall via the pressure cushion to the other beam. This beam is connected by flexurally elastic elements to the first-mentioned beam only at its two ends and can bend freely under the support force of the pressure cushion. Thus, no means are provided for coupling the beams at locations along the beams which are between the two ends. See for instance, Federal Republic of Germany OS 36 14 302, which is equivalent to U.S. Pat. No. 4,770,745. When the one beam, which is part of the flow guide wall, bends for any reason, the pressure of the pressure cushion is changed in such direction as to cancel the bend.

2. One of the two beams is developed as a ledge which is moveable in operation for the resilient supporting of a wire screen in the region of the double wire zone of a paper making machine; in this connection it is displaceable or swingable with regard to the other beam. In such case, the hydraulic support device acts as a resilient lift device. Any change in the pressure of the pressure cushion therefore produces a change, for instance, in the distance between the two beams and a change in the force which is applied by the ledge against the wire. Thus, no means are provided for limiting a change in the distance between the two beams while there is pressure in the pressure cushion and during pressing of the contact surfaces on the pressure cushion. See, for instance, International Application WO 89/02499.

From FIGS. 1 to 5 of the above-cited German OS 36 14 302 it is known to use a tube as pressure cushion. This tube, seen in cross section, is pressed more or less flat depending on the distance between the two beams. The distance between the two beams is generally not the same over the length of the beams, primarily because the one beam is bent relative to the other beam. This has the result that the supporting force of the pressure cushion along the length of the beams (i.e. over the width of the machine) varies relatively greatly from a desired constant value.

From FIGS. 6 to 8 of Federal Republic of Germany OS 36 14 302 it is known that the individual pressure cushion can have a bellows-like profile with side walls folded inward. In this way, it has been attempted to eliminate the aforementioned disadvantage. In other words, by this proposal it was attempted to obtain a constant value of the support force over the width of the machine despite the different distance between the two beams over the width of the machine. However, this proposal is also unsuccessful even though the width of the contact surface between the pressure cushion and the beams remains the same with different distances between the two beams. The reason for this is that the internal pressure in each inclined section of the side wall produces a component of force which represents a disturbing force acting perpendicularly on the adjacent contact surface. The amount of this disturbing force depends on the inclination of the section of the side wall and thus on the distance between the two beams. Another disadvantage of this known embodiment is that it is very difficult to produce a pressure cushion which has such inwardly folded side walls and nevertheless withstands the necessary internal pressures.

SUMMARY OF THE INVENTION

The object of the present invention is further to improve the above-described hydraulic support device in such a manner that the supporting force produced by the pressure cushion does not change, or at least changes only slightly, when the distance between the two beams is different along the length of the beams (for instance, as a result of the the two beams changes in operation for some other reason. There are two parallel beams and at least one adjustable pressure cushion extending longitudinally and in contact with the contact surfaces of the two beams. The invention sees to it that—at least on one of the two beams—the pressure cushion exerts a supporting force which is at least approximately constant over the length of the beam under all operating conditions which occur. This is achieved in the manner that, seen in cross section, a free space is present on both sides of the contact surface the width of which is less than the total width of the pressure cushion and a loop of the pressure cushion which may be in the form of a pressure filled tube, extends into such free space. The supporting force is now formed by the pure pressure force, which depends on the internal pressure and on the width of the contact surface, and by clamping forces which result from the internal pressure within the loops. If now, with the same internal pressure, the distance between the two beams changes, the width of the contact surface remains at least approximately the same; furthermore, the clamping forces change only slightly or (in particularly favorable cases) not at all.

Compared with the above-mentioned known forms of pressure-cushions a constant value of the supporting force is obtained, at least in good approximation, along the length of the beams even if the distance between the two beams is not the same at different places.

The features set forth above are, to be sure, already known from U.S. Pat. No. 4,559,105, but that patent concerns an entirely different type of hydraulic support device. There is involved there a ledge which serves to support a wire, but the ledge is not arranged resiliently. The ledge rests on a beam of C-shaped cross section which is placed over a beam of T-shaped cross section. In order to facilitate the assembling of the two beams, a certain play is provided. In order to exclude the play during operation, the two beams are clamped together by a pressure cushion so that they form a form-locked unit in operation. Thus, the known construction cannot make use of the above-described advantages of the present invention.

A side surface at each side of each beam and spaced away from the side of the contact surface defines a free space for the pressure cushion.

Coupling means at the longitudinal ends of and between the beams flexurally permit the beams to tilt traversely to their lengths.

Advantageous features of the invention are explained below with reference to embodiments shown in the accompanying drawings.

BRIEF DESCRIPTION OF THE DRAWINGS

FIG. 2 is a partial cross section through a ledge for the resilient supporting of a wire screen in a double-wire arrangement.

FIG. 2A shows the ledge of FIG. 2 in a position drawn back from the wires.

DETAILED DESCRIPTION OF THE PREFERRED EMBODIMENTS

Figures 1, 1A:
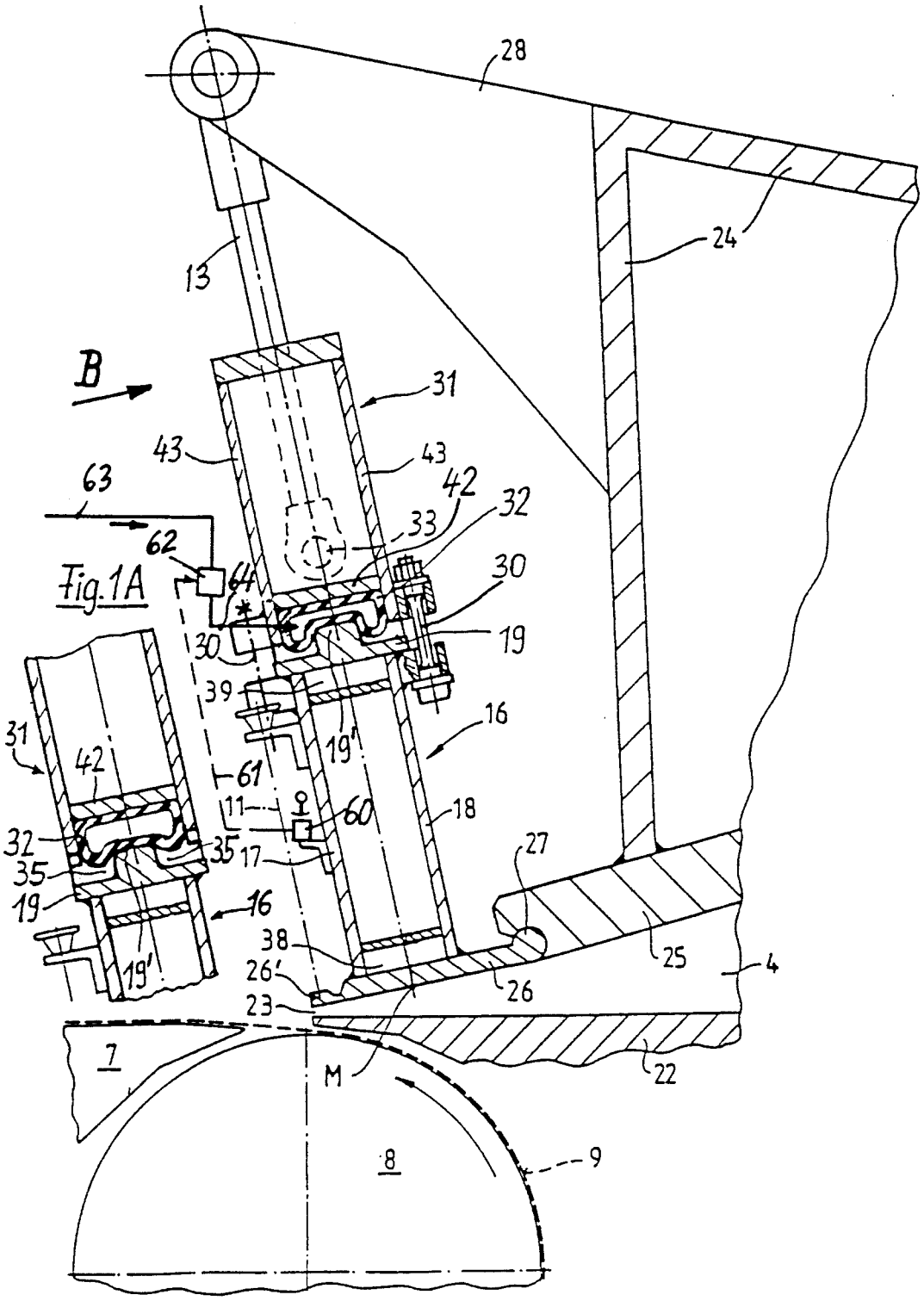
FIG. 1 shows a longitudinal section (along the line I—I FIG. 1B) through the head box of a paper making machine having a hydraulic support device provided between two beams.
FIG. 1A shows a portion of FIG. 1 with enlarged distance between the beams (section along the line A—A of FIG. 1B).
Figure 1B:
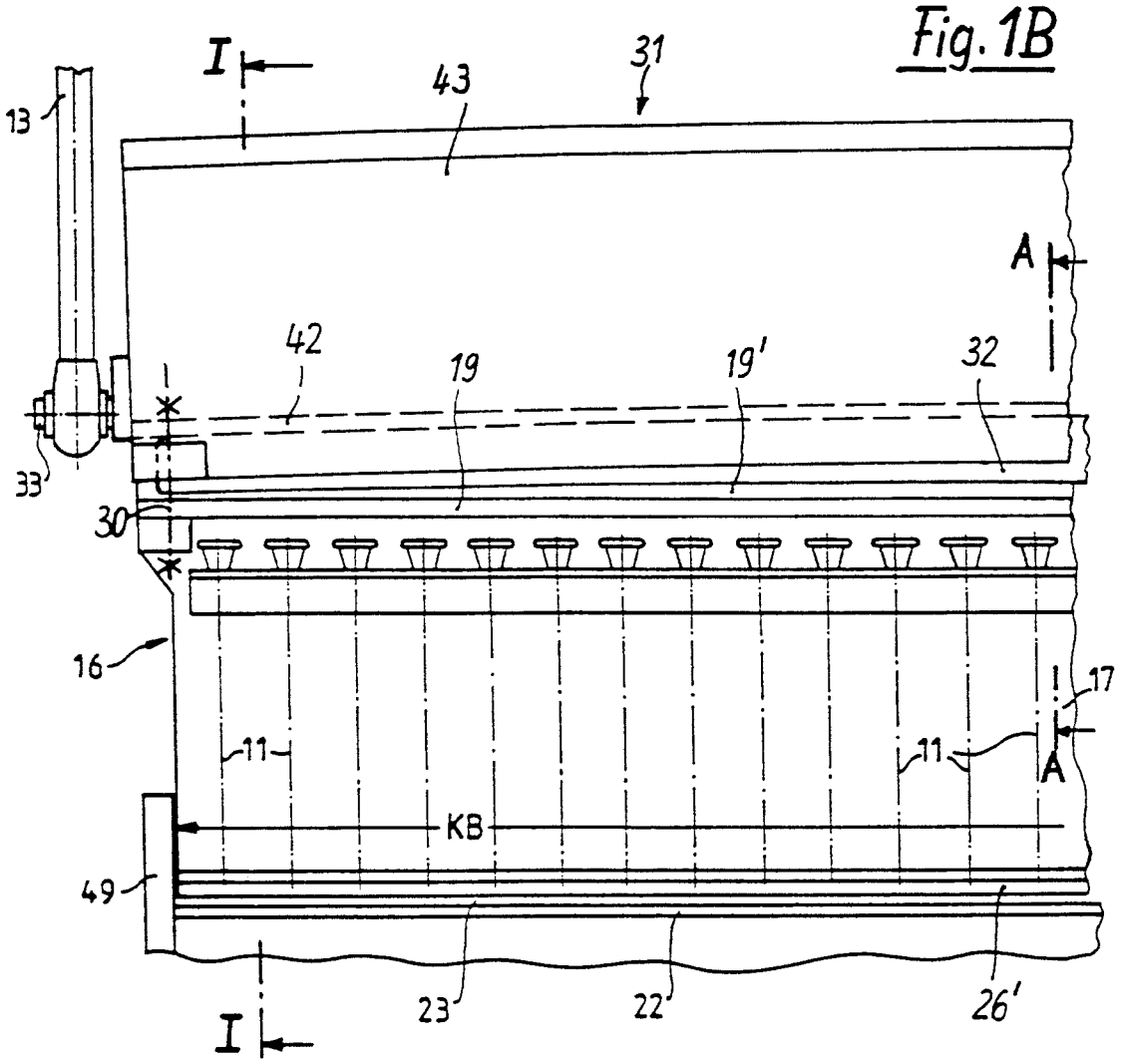
FIG. 1B is a partial view seen in the direction of the arrow B in FIG. 1.

The head box shown in FIGS. 1, 1A and 1B serves, as is known, for feeding a machine-wide jet of pulp onto the endless wire/screen/or wire 9 of a paper manufacturing machine. The wire 9 travels inter alia over a breast roll 8 arranged at the head box and over a wire table 7. For forming the jet of pulp, the head box has a nozzle-like outlet channel 4 which is limited by a lower stationary channel wall 22 and an upper channel wall 25, 26. The upstream part 25 of the upper channel wall is also stationary in the embodiment shown, i.e. it is part of the stationary head box housing 24. The downstream part 26 of the upper channel wall is moveable in order to be able to change the size of the inside opening of the outlet slot 23. This mobility is preferably obtained in the manner that the downstream part 26 is fastened by a hinge 27 to the upstream part 25.

In order to stiffen the moveable channel wall 26, a beam, namely a so-called channel-wall support 16, is placed on its top and rigidly attached to it (for instance, by welding). The channel-wall support 16 is preferably of box shape; it has a front wall 17, a rear wall 18, and an upper wall 19.

Above the channel-wall support 16 there is another beam, namely a support beam 31, which is also of box shape. Both beams 16 and 31 are shown in cross section in FIG. 1; they extend over the entire width KB of the machine between sides 49 (FIG. 1B) and are attached by means of flexibly soft connecting elements 30 merely at their two ends (i.e. on the operator side and on the driven side of the paper machine). The support beam 31 has a pin 33 on both of its ends. With the pin there is connected a lift device of which only a spindle 13 and a bearing bracket 28 fastened to the housing 24 are diagrammatically in FIG. 1.

Between the channel wall support 16 and the support beam 31 there is a pressure cushion 32, preferably in the form of a tube, which can be acted on by a liquid under pressure. It would also be conceivable here to use a membrane instead of the tube. The pressure prevailing in the pressure cushion 32 is variable (by means of control elements, not shown). It can for instance be so dimensioned, with due consideration of the liquid pressure prevailing in the outlet channel 4 and of the weight itself of the moveable channel wall 26 and of the channel wall support 16, that the moveable channel wall 26 is completely free of bend. In this connection, the support beam 31 is bent slightly upwards, as can be noted from FIG. 1B. It is advisable in this case to regulate the liquid pressure as a function of a continuous measurement of the bending of the channel wall support 16 (as known per se from U.S. Pat. No. 3,994,773, incorporated herein by reference. As shown in that reference, the measuring device 60 in FIG. 1 hereof continuously detects the bending of deflection of the channel wall support 16 and emits a corresponding signal via line 61 to valve 62. The valve 62 is arranged in a liquid feed line connected to the cushion 32. Therefore, the valve 62 is able to regulate the cushion pressure as a function of the bending of the support 16.

Heat-treatment channels 38 and 39 are provided within the channel wall support 16.

It is diagrammatically indicated that the outermost end 26' of the moveable channel wall 26 can be deformed locally as known per se, by means of a plurality of individually actuatable spindles 11. In this way, minor local corrections of the inner size of the outlet slot 23 can be effected.

The upper wall 19 of the channel wall support 16 is provided on its top with a ledge 19'. The top of this ledge 19' forms a so-called contact surface of the channel wall support 16 against which the pressure cushion 32 lies. As shown in FIG. 1, the width of the contact surface of the ledge 19' is smaller than the total width of the pressure cushion 32. In this way, a free space 35 remains on each side of the ledge 19' (FIG. 1A), the free space being more or less filled by a loop of the pressure cushion 32. The support beam 31 has a lower wall 42 and side walls 43. The latter extend downward beyond the lower wall 42 where there they support the pressure cushion 32 on its side. The width of the lower wall 42 is thus substantially the same as the total width of the pressure cushion. In other words, almost the entire outer surface of the lower wall forms the contact surface of the support beam 31 for the pressure cushion 32.

FIG. 1A shows the pressure cushion 32 and the adjoining parts of the two beams 16 and 31 at a point of the head box where, as a result of bending of the support beam 31, there is a somewhat greater distance between the two beams. As can be seen, the width of the contact surface (top of the ledge 19') between the pressure cushion 32 and the channel wall support 16 is unchanged as compared with FIG. 1. For the reasons indicated above, the support force exerted by the pressure cushion on the channel wall support 16 is the same in FIG. 1A as in FIG. 1. In other words, with respect to FIG. 1B, the supporting force exerted by the pressure cushion on the channel wall support 16 is constant over the entire length of the beams 16 and 31.

In FIG. 2 there are symbolically indicated in dot-dash lines two wire screens or wires 6 and 9 of a double-wire end of a paper making machine. The upper wire 6 slides along the bottom of ledges 5 which are rigidly arranged in the machine. The lower wire 9 slides over a resilient ledge, designated generally as 50. It consists essentially of a ceramic head ledge 51 which is fastened on a moveable beam 52; the latter is referred to below as the "moveable support ledge". Furthermore, a stationary beam 53 is provided, referred to below as the "stationary guide ledge". Between the moveable support ledge 52 and the stationary guide ledge 53 there is a pressure cushion 54. All of these parts extend transverse to the direction of travel of the wire, and preferably over the entire width (about 2 to 10 meters) of the wires 6 and 9. The pressure cushion 54, is again preferably developed as a tube.

The moveable support ledge 52 has in the center of its inner side a projection 52' of approximately square cross section but rounded, which corresponds to the ledge 19' in FIG. 1.

A similar projection can also be provided on the stationary guide ledge 53. Each of these projections forms a contact surface against which the pressure cushion 54 acted on by pressure rests.

The width b of each of the two contact surfaces is again less than the total width B of the pressure cushion 54. Furthermore, free spaces 55 are provided on both sides of each contact surface, into which spaces the lateral regions of the pressure cushion extend to a greater or lesser extent. As soon as the distance a between the contact surfaces becomes less than shown in FIG. 2, each lateral region of the pressure cushion 54 forms a loop which fills out the free space 55 to a greater or lesser extent. In the extreme case as shown in FIG. 2A, the pressure cushion 54 is without pressure so that the moveable support ledge 52 (together with the head ledge 51) is moved away from the wires 6 and 9. The free spaces 55 are limited inter alia by side surfaces 56 of the projections 52' and 53'.

The distance a may change in operation; it may become greater or lesser than what is shown in FIG. 2. This can take place, for instance, if the amount of fiber pulp introduced between the two wires 6 and 9 changes. In such case, with constant cushion pressure only a slight change in the support force transmitted takes place despite the deformation of the pressure cushion. In this way, the result is obtained that the force with which the ledge 50 is pressed against the lower wire 9 (and thus the dewatering pressure in the pulp) remains unchanged. Furthermore, when the stationary guide ledge 53 bends and therefore when the distance a differs over the length of the guide ledge 53, the value of the supporting force which the pressure cushion 54 exerts on the moveable support ledge 52 is nevertheless substantially more uniform over the length thereof than in the case of the conventional constructions. It is thus unnecessary to provide a plurality of shorter pressure cushions in a row one behind the other and to act with different pressures on these pressure cushions (known from FIG. 7 of the aforementioned WO 89/02499). If a plurality of shorter pressure cushions arranged in a row are used in the construction of the invention, then all of these pressure cushions are acted on with the same pressure.

For the lateral guiding of the pressure cushion 54, it has two longitudinal ribs 57 which engage in corresponding longitudinal grooves in the projections 52, 53. As can be seen, there is no stop which would limit the stroke of the moveable ledge 50 in upward direction in operation.

We claim:

1. A hydraulic support device in a paper making machine in combination with and for supporting a first beam and a second beam, wherein the beams extend parallel to each other, each of the beams having two opposite ends, and further comprising means for coupling the beams to each other at each of their respective two opposite ends and without the beams being coupled at locations along the beams which are between their opposite ends, the device comprising:

the first beam having a first contact surface extending over the length of the first beam and facing toward the second beam;

the second beam having a second contact surface extending over the length of the second beam and facing toward the first beam;

pressure cushion means between and contacting the first and the second contact surfaces for supporting the second beam on the first beam, the pressure cushion means having pressure fluid therein, the pressure of which is variable but which is uniform over the length of the pressure cushion means along the contact surfaces;

means for controllably varying the pressure in the pressure cushion means during operation of the support device; and in the width direction across the first beam and the pressure cushion means, the second contact surface has a width substantially equal to a total width of the pressure cushion means, the first contact surface has a width less than the total width of the pressure cushion means, the first contact surface being so shaped and the first beam at its region next to the contact surface and in the width direction being so shaped as to define a free space on each side in the width direction of the first contact surface into which each space extends a part of the pressure cushion means that is beyond the width of the first contact surface.

2. The hydraulic support device of claim 1 wherein the pressure cushion means comprises a tube with a pressure fluid therein and extending over the length of the contact surfaces.

3. The hydraulic support device of claim 2, wherein the tube has a cross section such that when the contact surfaces press against the tube, a loop of the tube is developed beyond each side of the first contact surface, each loop extending into the respective free space at each side.

4. The hydraulic support device of claim 3, further comprising guide walls on the second beam extending transversely to the second contact surface and spaced outward of the tube to laterally support the tube when it is deformed under pressure from the first and second contact surfaces, and also define the space for the loop of the tube.

5. The hydraulic support device of claim 1, wherein there is at least one of the pressure cushion means.

6. The hydraulic support device of claim 1, wherein there is only one of the pressure cushion means.

7. The hydraulic support device of claim 1, wherein the pressure cushion means is of a length along the contact surfaces to extend up to the opposite ends of the beams.

8. The hydraulic support device of claim 1, wherein the coupling means comprise flexurally elastic elements.

9. In combination, a paper making machine headbox and the hydraulic support device of claim 1;

the headbox comprising first and second flow guide walls which define an outlet slot for pulp and the first wall being movable toward and away from the second wall;

the first beam of the hydraulic support device being part of the first wall of the head box.

10. The hydraulic support device of claim 1, further comprising guide walls on the second beam extending transversely to the second contact surface and spaced outward of the pressure cushion means to laterally support the pressure cushion means when it is deformed under pressure from the first and second contact surfaces.

11. The hydraulic support device of claim 10, wherein the guide walls are outward of the sides of the first contact surface.

12. A hydraulic support device in a paper making machine in combination with and for supporting a first moveable beam and a second stationary beam, wherein the beams extend parallel to each other, the device comprising:

the first beam having a first contact surface extending over the length of the first beam and facing toward the second beam;

the second beam having a second contact surface extending over the length of the second beam and facing toward the first beam;

pressure cushion means between and contacting the first and the second contact surfaces for supporting the first beam on the second beam, the pressure cushion means having pressure fluid therein, the pressure of which is variable but which is uniform over the length of the pressure cushion means along the contact surfaces;

means for controllably varying the pressure in the pressure cushion means during operation of the support device, wherein the pressure cushion means supports the first beam to be freely movable over the entire length of the first beam relative to the second beam and transversely to the longitudinal direction of the beams under change in pressure in the pressure cushion means, such that as the first beam is moved, the distance between the first and second surfaces varies along the length of the beams, but the pressure in the pressure cushion means supporting the first beam is uniform along the length of the beams; and in the width direction across the first beam and the pressure cushion means, at least the first contact surface has a width less than a total width of the pressure cushion means, the first contact surface being so shaped and the first beam at its region next to the contact surface and in the width direction being so shaped as to define a free space on each side in the width direction of the first contact surface into which each space extends a part of the pressure cushion means that is beyond the width of the first contact surface.

13. In combination, twin wires of a paper making machine and the hydraulic support device of claim 12, the wires being movable past the hydraulic support device, the first beam of the hydraulic support device defining a resilient support ledge for one of the wires and wherein the beams extend across the wires moving past.

14. The hydraulic support device of claim 12, wherein each of the first and second contact surfaces is of a width less than the total width of the pressure cushion means under pressure from the contact surfaces, each of the beams having side surfaces at opposite sides of their respective contact surfaces in the width direction, the side surfaces of each beam extending away from the respective contact surface thereof and limiting and defining the free space, whereby each side of each of the respective beam having the respective contact surface forms each respective free space.

15. The hydraulic support device of claim 14, wherein the pressure cushion means comprises a tube having a pressure fluid therein and extending over the length of the contact surfaces, the tube having a cross section such that when the contact surfaces press against the tube, a loop of the tube is developed beyond each of the sides surfaces of the beams to extend into each respective free space.

16. The hydraulic support device of claim 12, further comprising at least one longitudinal rib on the pressure cushion means extending along at least the first contact surface, and at least the first contact surface having a longitudinal groove into which the rib extends.

17. The hydraulic support device of claim 12, wherein the first beam includes a ledge and the first contact surface is formed by the ledge.

* * * * *